US006160495A

United States Patent [19]

Demink et al.

[11] Patent Number: 6,160,495

[45] Date of Patent: Dec. 12, 2000

[54] DEVICE FOR PRESENTING MULTIPLE ILLUMINATED MESSAGES AND A METHOD FOR MAKING SAME

[75] Inventors: Lon A. Demink; Bernard Diffin, both of Kalamazoo, Mich.

[73] Assignee: deMco Technologies, Inc., Kalamazoo, Mich.

[21] Appl. No.: 09/225,908

[22] Filed: Jan. 4, 1999

Related U.S. Application Data

[60] Provisional application No. 60/070,461, Jan. 5, 1998.

[51] Int. Cl.[7] ..... G08G 1/095

[52] U.S. Cl. ..... 340/944; 340/907; 340/917; 340/925; 116/63 R; 40/541; 40/557

[58] Field of Search ..... 340/944, 925, 340/332, 917, 907, 815.42, 815.43, 815.55, 815.73; 362/812; 116/63 R; 40/545, 541, 553, 557

[56] References Cited

U.S. PATENT DOCUMENTS

| | | | |
|---|---|---|---|
| 3,085,224 | 4/1963 | Becka | 340/105 |
| 3,101,177 | 8/1963 | Loomis et al. . | |
| 3,564,495 | 2/1971 | Gould et al. | 340/44 |
| 3,863,251 | 1/1975 | Gould et al. | 340/382 |
| 3,873,969 | 3/1975 | Gould et al. | 340/107 |
| 4,212,003 | 7/1980 | Mishoe et al. | 340/574 |
| 4,887,003 | 12/1989 | Parker | 313/634 |
| 4,914,435 | 4/1990 | Gould et al. | 340/144 |
| 4,990,826 | 2/1991 | Cocks et al. | 313/485 |
| 5,132,683 | 7/1992 | Gould et al. | 340/944 |
| 5,136,287 | 8/1992 | Borenstein | 340/925 |
| 5,654,705 | 8/1997 | Houten et al. | 340/944 |

*Primary Examiner*—Jeffery A. Hofsass
*Assistant Examiner*—Toan Pham
*Attorney, Agent, or Firm*—Flynn, Thiel, Boutell & Tanis, P.C.

[57] ABSTRACT

A device for presenting multiple illuminated messages and a method for making same. The device includes a uniformly thick panel of transparent material having at least one elongated and continuous passageway therein forming a message to be indicated. The passageway is filled with gas and materials that emit light.

24 Claims, 9 Drawing Sheets

1. Electrode lead-in wire holes - front channel

2. Electrode lead-in wire holes - back channel

3. Fill tube hole - front channel

4. Fill tube hole - back channel

1. Electrode lead-in wire holes - front channel
2. Electrode lead-in wire holes - back channel
3. Fill tube hole - front channel
4. Fill tube hole - back channel

DEVICE FOR PRESENTING MULTIPLE ILLUMINATED MESSAGES AND A METHOD FOR MAKING SAME

This application claims benefit of Provisional application 60/070,461, filed Jan. 5, 1988.

FIELD OF THE INVENTION

The invention relates to a sign that is capable of presenting two separate illuminated messages or signals in substantially the same or side-by-side surface area, one message or signal being illuminated while the other remains on or is extinguished. In addition, the invention also contains provision for novel means of supplying heat to the sign, enabling it to be operated in cold climates.

SUMMARY OF THE INVENTION

The invention is applicable to any situation in which two or more different messages are to be conveyed. For example, this may include many applications within the traffic and pedestrian control areas, "OPEN/CLOSED" signs, "VACANCY/NO VACANCY", etc.

The sign consists of a uniformly thick panel of transparent material (for example glass) in which separate first and second elongated and continuous passageways are presented, each forming the message to be indicated. The passageways are filled with gases and materials that emit light when an electrical discharge is passed through them via electrodes placed at each end of the channels. The first channel (viewed from the front of the sign) utilizes a gas (or gases) only, so that when it is not energized it is transparent, giving full view of the (energized) second channel. Such a gas is neon. The second channel may either contain a gas or gases, or an argon-mercury mixture. If such a mixture is used then at least part of the transparent material comprising the walls of this channel is coated with a phosphor that emits light of a chosen color under excitation by radiation emitted from the argon-mercury discharge.

DETAILED DESCRIPTION

Figure 1:
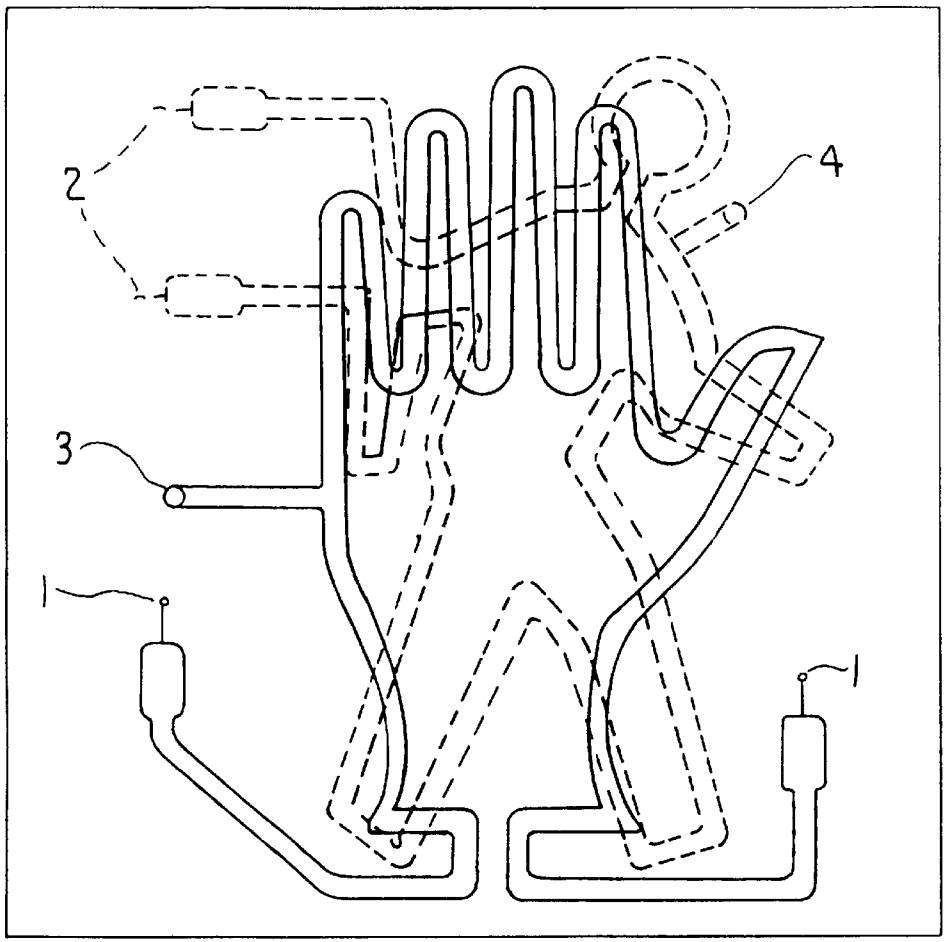
FIG. 1 is a front view of a panel or plate having a pedestrian sign formed thereon.
Figure 10:
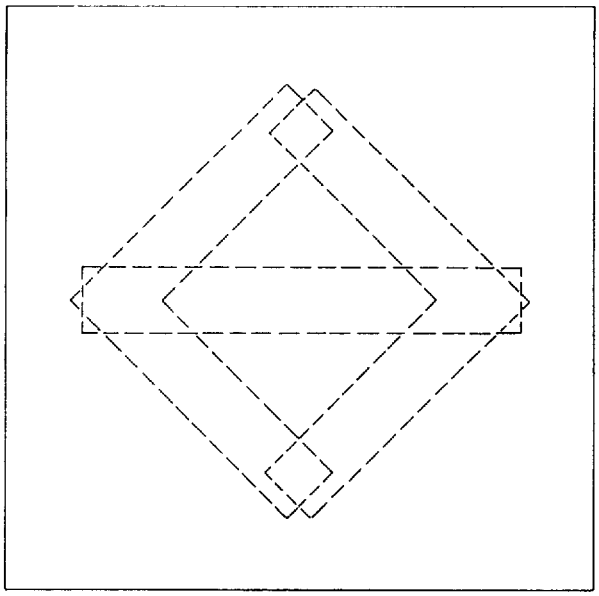
FIG. 10 is a front view of a panel embodying the invention for indicating a left or a right pointing arrow.
Figure 11:
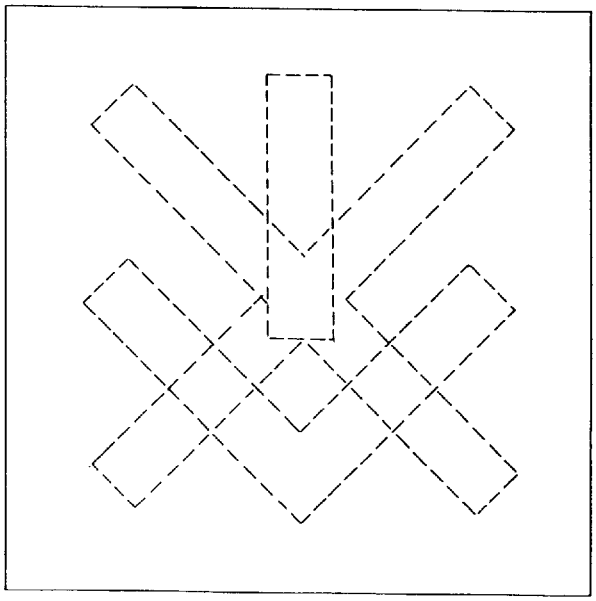
FIG. 11 is a front view of a panel embodying the invention for lane use control by indicating an "X" or a down pointing arrow.

To illustrate the advantages and mode of construction and operation, in this brief description we concentrate on traffic control products in general, and on the symbols (orange hand and white walking man) that internationally represent "WALK/DONT WALK". (Other applications in the traffic control field include, but are not restricted to, pedestrian control via the words "WALK/DONT WALK", lane use, lane control via an "X" and a down pointing arrow {FIG. 11}, direction indicators via left and right pointing arrows {FIG. 10}.) FIG. 1 shows the front view (i.e. the direction from which it is to be viewed) of the pedestrian crossing signal. The front (first) passageway or channel is in the form of a hand ("DONT WALK") and contains neon gas. The second channel (behind and separate from the first) is in the form of a walking man ("WALK") and contains argon gas and mercury. The area that comprises the back of the second channel is coated with a phosphor that emits white light when the channel is energized. Thus, when it is desired to convey the "DONT WALK" message, the neon (front) channel is energized, and when it is desired to display the "WALK" message, the argon/mercury/phosphor (back) channel is energized. Since the "DONT WALK" message is transparent when not energized, the "WALK" message is clearly seen when it is energized. Each channel is terminated with electrodes that provide the electrical energy required for energization, and electrical lead-in wires (1 & 2), that exit through the rear of the plate, contact these electrodes. Holes ( 3 & 4) are provided which provide the access necessary to remove air and fill the channels with the necessary gases.

When packaged as a pedestrian control signal, such a device also offers the following advantages over prior art:

Reduction of at least 50% in size of signal head without any reduction in size of individual message presented.

Reduced energy consumption

Reduced maintenance

Mode of Construction

Figure 2:
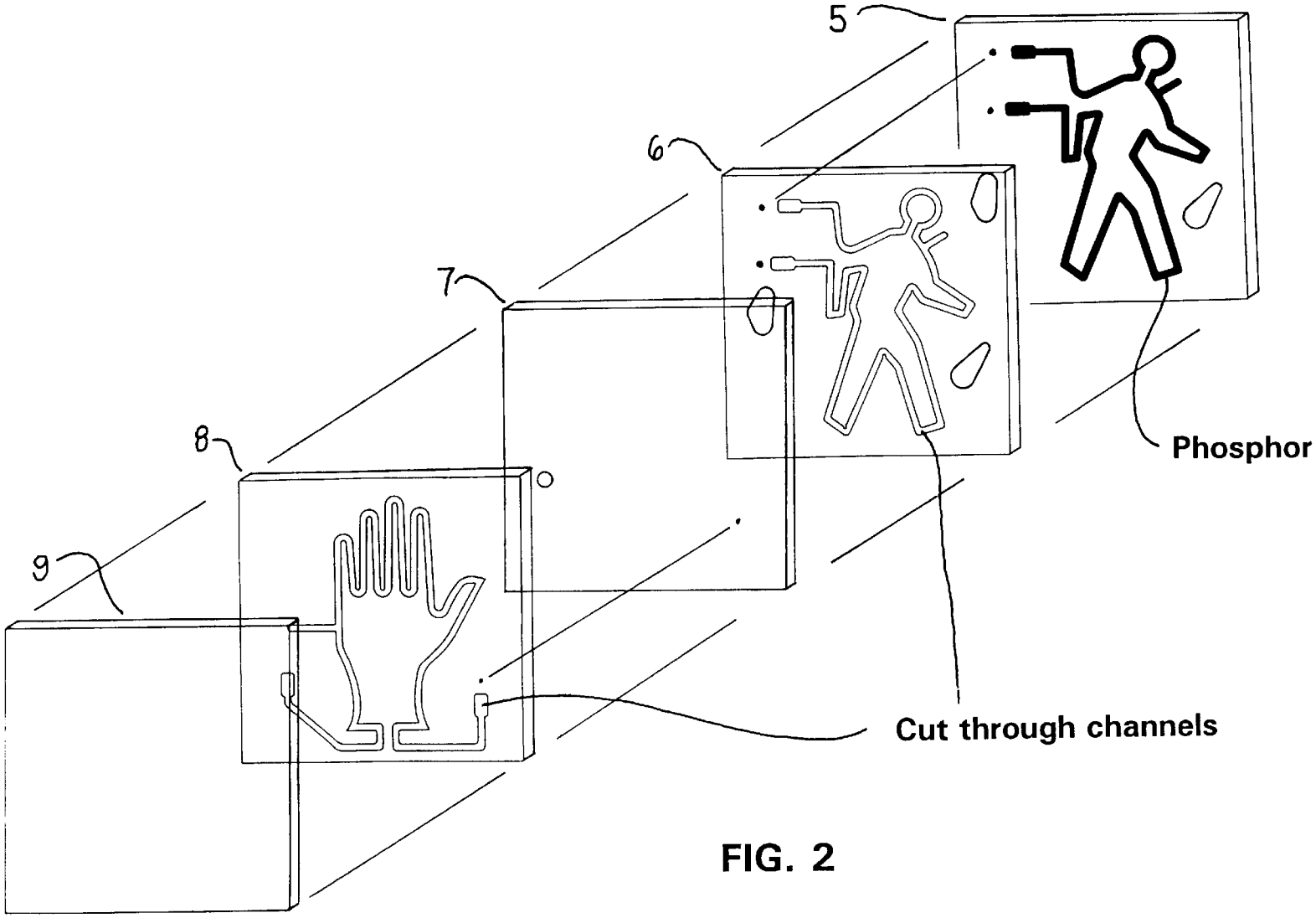
FIG. 2 is an exploded isometric view of a panel embodying the invention.

FIG. 2 shows an exploded view of one possible mode of construction of the pedestrian crossing signal. It consists of five transparent plates (5,6,7,8,9). Plates 6 and 8 have cut through them channels in the patterns of a walking man and a hand respectively. The back plate (5) has a phosphor applied to its inner surface in the pattern of a walking man in such a place that when it is interfaced with plate 6 the pattern coincides with that of the "man" channel in plate 6. Plate 7 comprises both the front plate of the WALK sign and the back plate of the DONT WALK sign. Both plates 5 & 7 have access holes cut through them for the introduction of electrical lead in wires connected to the electrodes (1 & 2) and fill tubes (3 & 4). Plate 9 is a transparent plate only, serving as a front plate for the DONT WALK sign.

Figure 3:
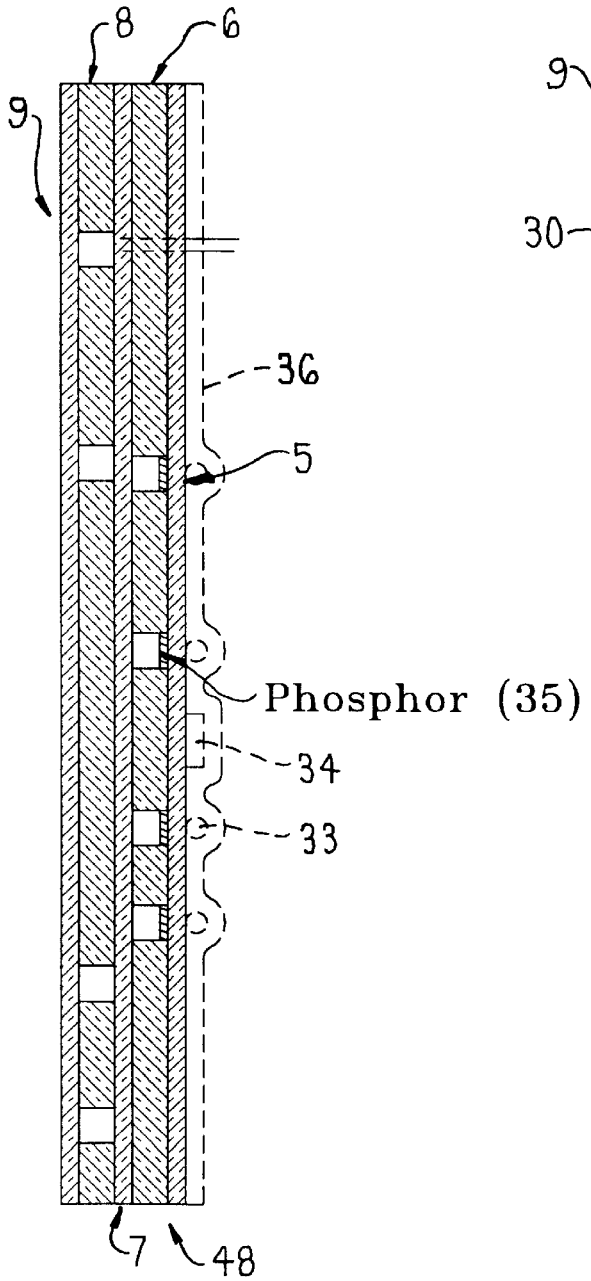
FIG. 3 is a sectional view through the panel of FIG. 1 and embodying the invention.

The plates are assembled and electrodes and lead-in wires are added. The layers are sealed so that one whole unit is obtained and the appropriate gases and mercury introduced via fill tubes, which are then hermetically closed. The sealing may be achieved in a variety of ways, including heat (fusing), glass frit, or suitable adhesives. FIG. 3 represents a section through the sealed unit. The structure shown in broken lines will be explained below in relation to FIGS. 7A and 7B.

Figure 4:
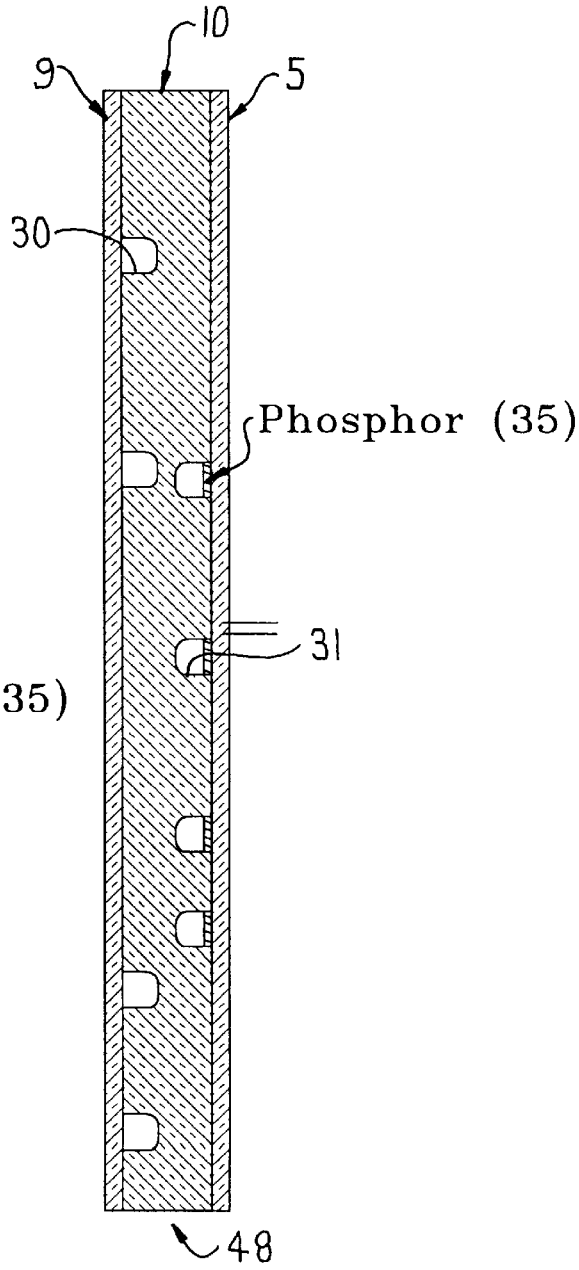
FIG. 4 is a sectional view through an alternate construction of the panel embodying the invention.

A section through a completed unit, which is the result of a second possible mode of construction, is shown in FIG. 4. Here, plates 6, 7 & 8 in the previous example are replaced by a single plate (10). In the front side of this plate is formed, via pressing, molding, routing or other means a trough 30 or channel in the form of the hand symbol. Similarly, the walking man symbol is formed by a trough 31 in the backside of the plate. Assembly is then achieved as in the previous example.

Heat Management for Operation in Cold Climates

Figure 6:
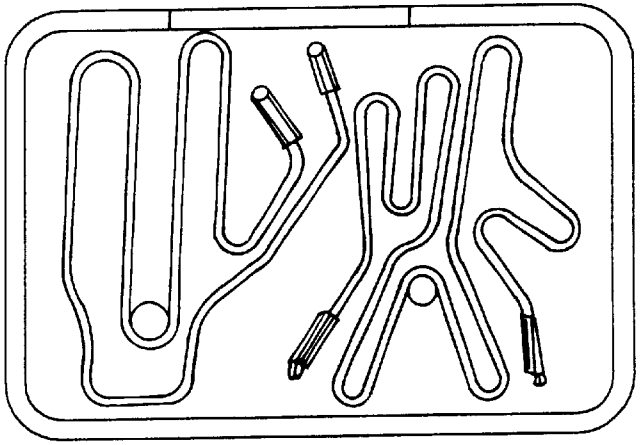
FIG. 6 (PRIOR ART)
FIG. 6 illustrates a prior art discharge tube in a pedestrian sign environment.
Figure 5:
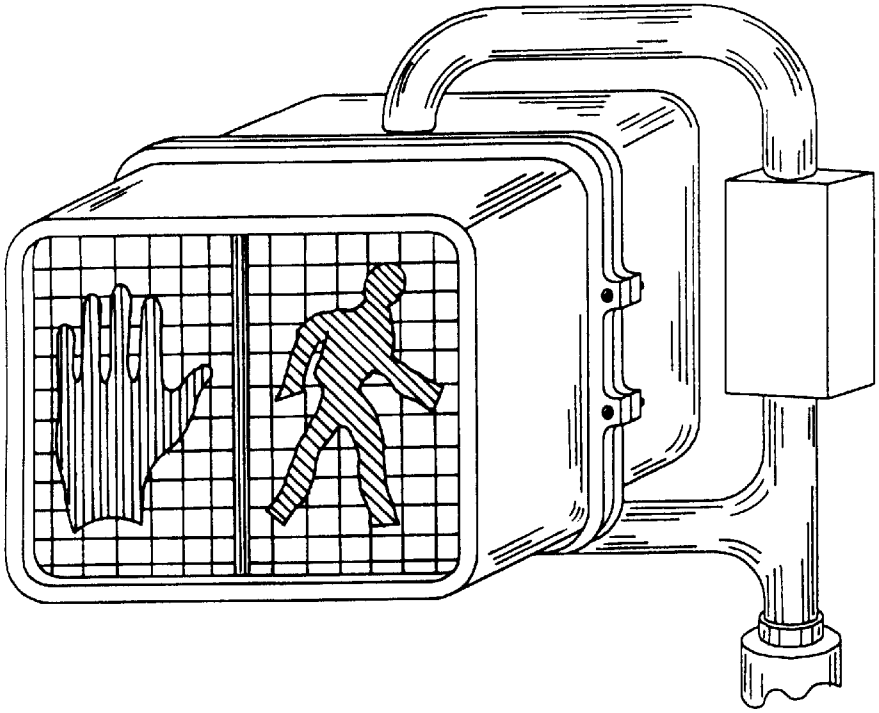
FIG. 5 (PRIOR ART)
FIG. 5 illustrates a prior art pedestrian sign.
Figure 7A:
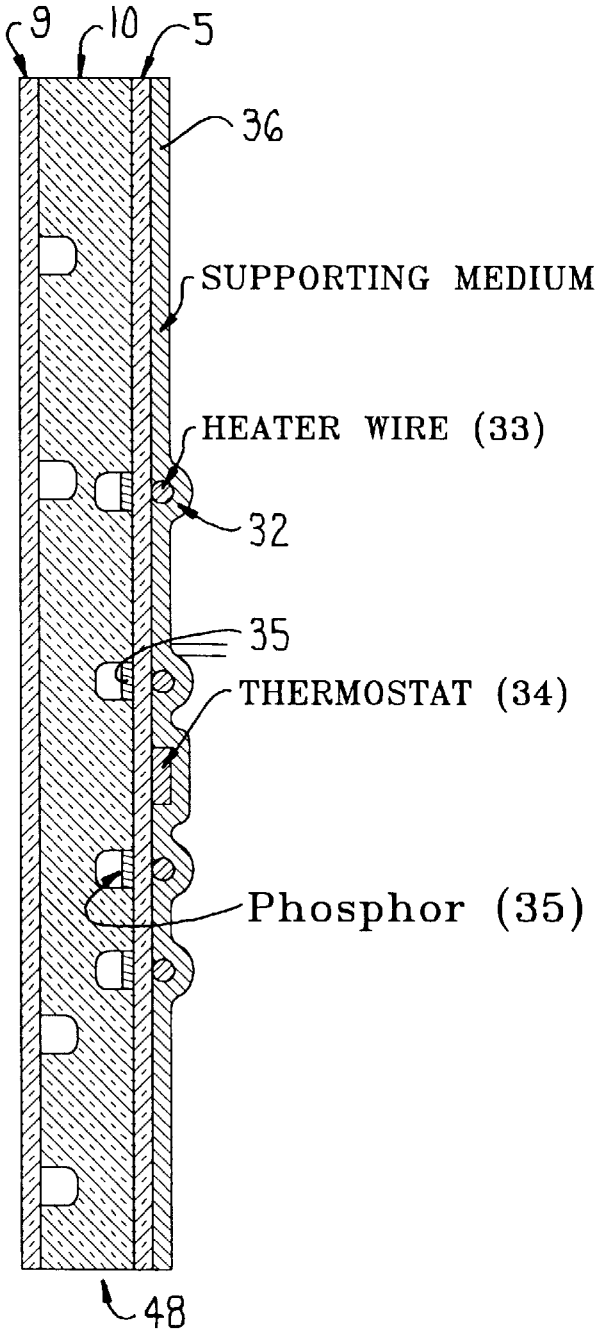
FIG. 7A is a sectional view through a further alternate construction of the panel.
Figure 7B:
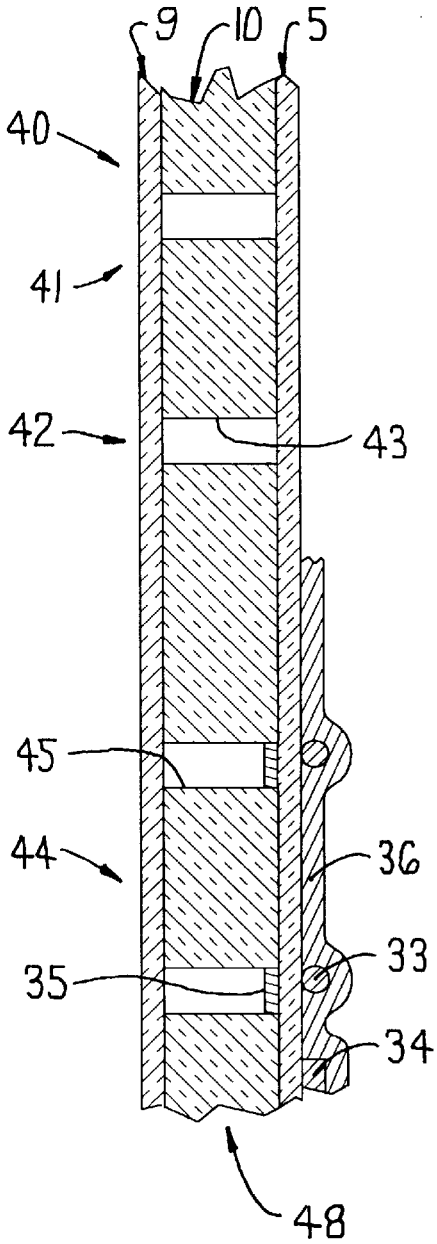
FIG. 7B is a sectional view through a still further alternate construction of the panel.

The prior art in the discussed areas of application includes the use of messages presented via light generated by discharge tubes. For example, FIG. 5 shows a pedestrian crossing signal that presents the symbols in a side-by-side manner. FIG. 6 shows a neon discharge tube (11) used to back light a transparent surface in the form of a hand, and a argon/mercury/phosphor tube 12 is used to back light a transparent surface in the form of a walking man. The successful operation of the argon/mercury/phosphor tube depends upon the maintenance of mercury vapor pressure within the tube, and as the ambient temperature drops, the amount of light emitted from the tube drops. Hence a noticeable decrease in brightness can occur, even at temperatures as high as 10° C. Obviously, this is undesirable in many situations. It is therefore advantageous to maintain the temperature of the argon/mercury/phosphor light emitter at the optimum for maximum tube brightness. This occurs at around 35° C. The current invention allows opportunities to achieve this. As shown in FIGS. 7A and 7B, and in broken lines in FIGS. 3, heat may be applied in the form of electrical energy by the placement of an electrical heater 32 on the rear of plate 5. Because the rear of plate 5 consists of a flat surface it allows an electrical heater wire 33 and thermostat 34 in series to be applied to it. The heater may consist of an electrical wire or printed "thick film" heating element well known in the art, which extends co-extensively with the applied phosphor 35 pattern. In this manner it is possible to control the supply of electrical energy to the heater wire to periods of time when the temperature of the rear of plate 5 is below a specified setting on the thermostat. Application of a heater in this way does not interfere with the production or transmission of light. Furthermore it allows for an efficient transfer of heat to the required area. FIGS. 7A, 7B and the broken lines of FIG. 3 show a representation of a heater wire and thermostat applied to the "molded" and "cut" version of the pedestrian crossing sign. A supporting medium 36, such as an adhesively backed tape or foil sheet, is utilized to hold the wire or tape 33 and thermostat in place on the rear side of the rear plate 5.

Additionally, the temperature of the argon/mercury/phosphor sign is constantly elevated above that of ambient by the warming action of the neon sign behind which it sits and in which it is in direct contact.

FIG. 7B illustrates a side-by-side sign 40 wherein a left side 41 of the sign viewed in the direction 42 has a neon discharge channel 43 and the right side 44 has a argon/mercury/phosphor channel 45 separate from the channel 43. Thus, the wire or thin film heater wire 33 is only required to be in association with the pattern formed by the channel 45 having the phosphor liner 35. In this embodiment, the message indica can be simultaneously or alternatingly displayed.

Mounting of Signal Panel to Produce Pedestrian Crossing Signal Unit

Figure 8:
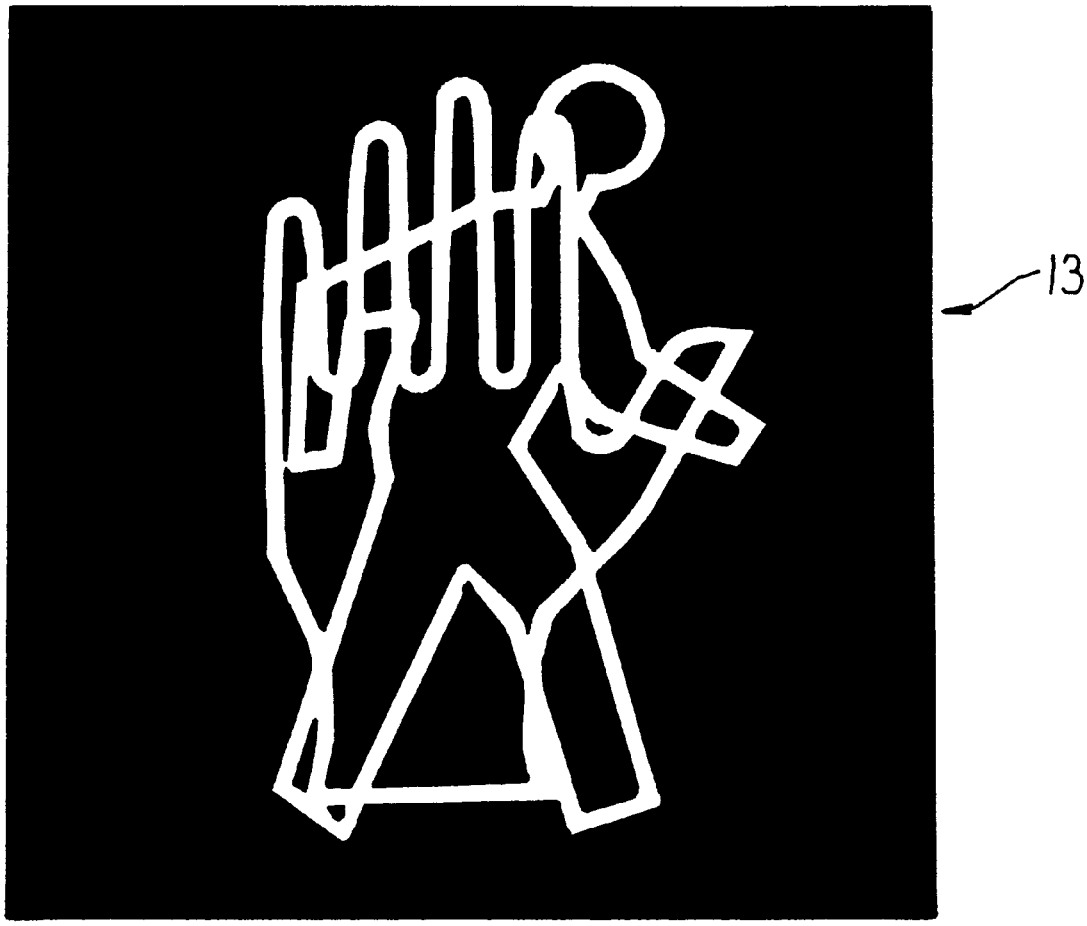
FIG. 8 is a front view of a mask.
Figure 9A:
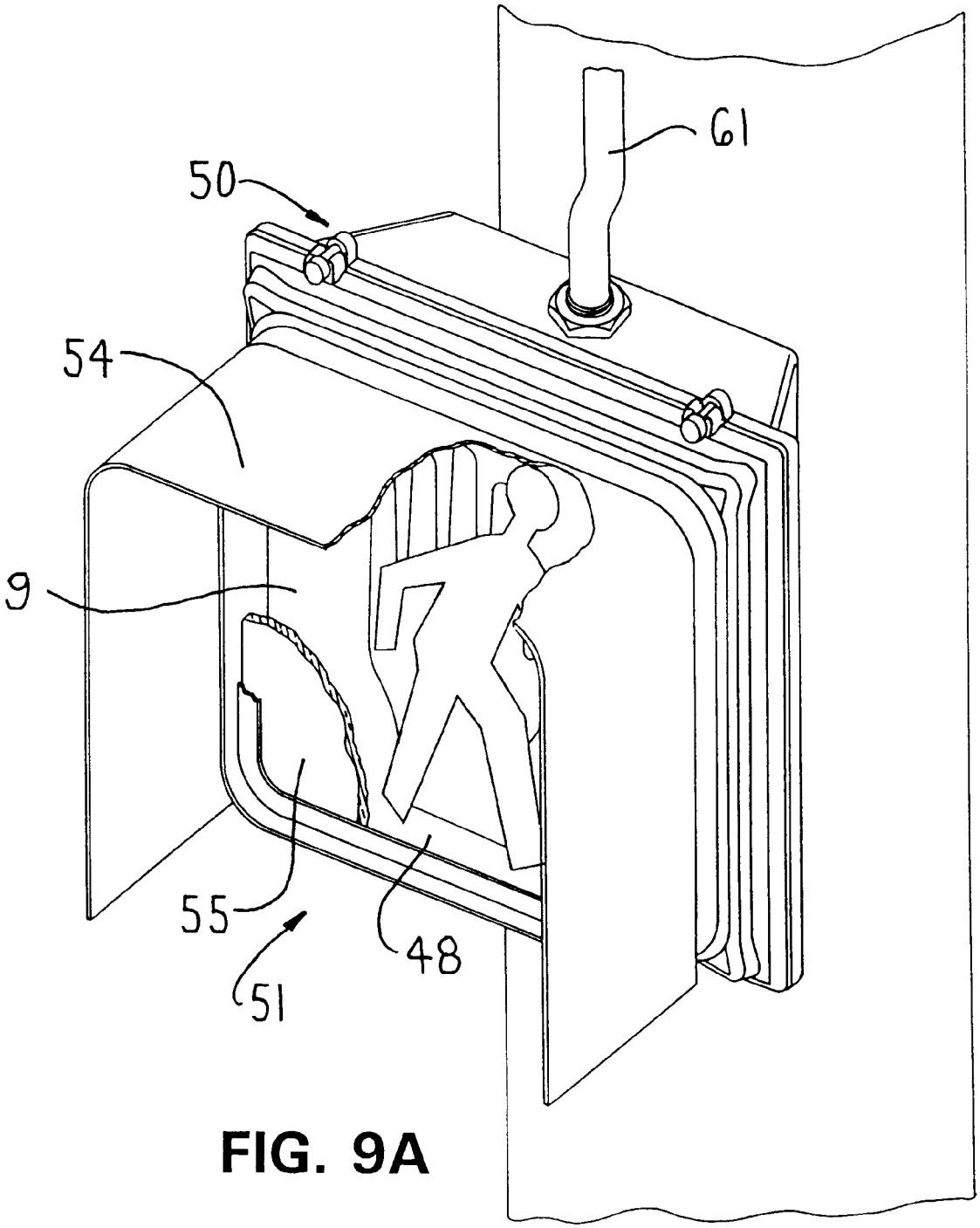
FIG. 9A is an isometric view of a pedestrian sign embodying the invention.
Figure 9B:
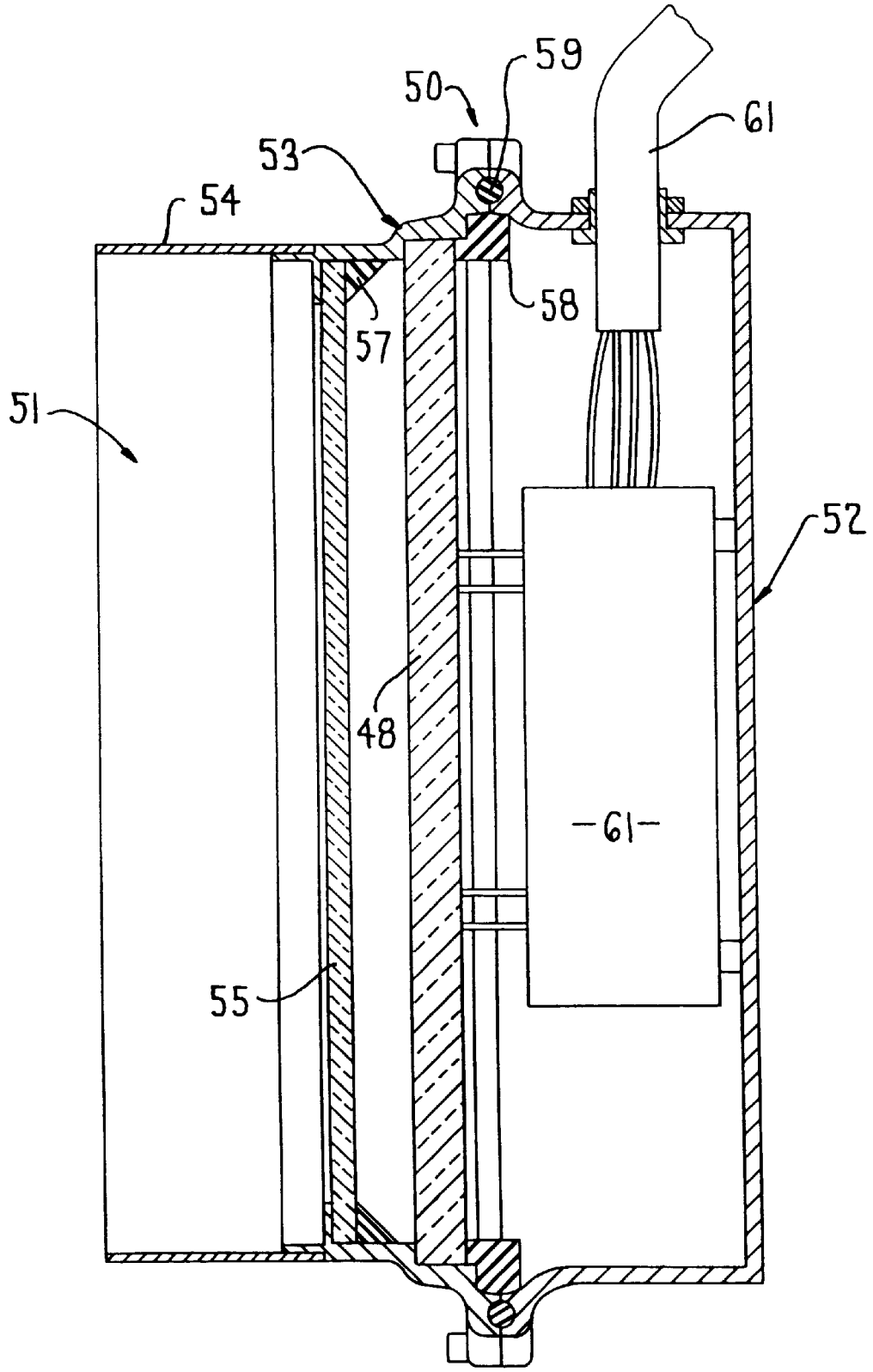
FIG. 9B is a sectional view through a housing for the pedestrian sign shown in FIG. 9A.

A mask 13 (FIG. 8) is attached to the front surface of the plural plates or panel 48 so that only those parts of the symbols that are intended to be visible are seen. The panel is then mounted in a housing 50 (FIG. 9A) having an open front side 51 and a closed backside 52 (see FIG. 9B). This may take form of housing well known in the art or an adaptation thereof. The housing 50 includes a removable cover or hinged door 53 into which the panel is mounted in such a manner that the messages are visible. A visor 54 may be added in the customary way, or alternatively a microlouvered coating (such as manufactured by the 3M Company) may be applied to or near the panel's front surface. Such a coating or film offers the advantage of allowing light to pass only at a defined angle, thus eliminating the well known phenomenon of "washout" of the signal under periods of direct illumination from the sun. It may also allow the signal to be clearly visible in full sunlight without the aid of a visor or other form of shade. The assembly may also include a transparent plate 55 mounted a short distance in front of the front surface of the panel 48. This serves both as a protective device and as a further means of minimizing heat loss in cold weather. A device (power supply 56) for supplying the necessary voltage and current to illuminate the messages is provided inside the housing 50. Appropriate seals and gaskets 57, 58 and 59 are employed to keep the weather out of the housing 50. A main electrical supply wire 61 is connected to the power supply 56 and extends through a hole in a wall of the housing 50.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An illuminated sign, comprising:

a uniformly thick panel of solid transparent material having large area frontwardly and rearwardly facing surfaces;

separate first and second elongated and continuous passageways in said panel oriented between said frontwardly and rearwardly facing surfaces, said first passageway being oriented uniformly adjacent said frontwardly facing surface and said second passageway being oriented uniformly adjacent said rearwardly facing surface, both of said first and second passageways being visible through at least one of said frontwardly facing surface and said rearwardly facing surface;

an electrically energizable gas sealed in each passageway; and spaced electrodes in each of said passageways so that electrical energy selectively applied to said electrodes in one passageway will effect an electrical energization of said gas therein independent of an electrical energization of said gas in an other of said passageways.

2. The illuminated sign according to claim 1, wherein all of said first passageway is transparent to thereby make visible through said frontwardly facing surface all of said second passageway.

3. The illuminated sign according to claim 2, wherein said first passageway is oriented directly between said second passageway and said frontwardly facing surface.

4. The illuminated sign according to claim 3, wherein said electrically energizable gas in said first passageway is neon.

5. The illuminated sign according to claim 4, wherein said electrically energizable gas in said second passageway is an argon-mercury vapor, and wherein an interior of said second passageway is at least partially coated with a non-transmissible phosphor.

6. The illuminated sign according to claim 1, wherein said uniformly thick panel of solid transparent material is mounted in a housing having an open front side and a closed back side, said panel occupying a majority of an area of said open front side.

7. The illuminated sign according to claim 6, wherein said housing includes a removable cover for closing said open front side when in a closed position thereof and providing access to an interior of said housing when in an opened position thereof, and wherein said cover has an opening therethrough through which said frontwardly facing surface and said first and second passageways are visible.

8. The illuminated sign according to claim 7, wherein said uniformly thick panel of solid transparent material is mounted on said cover.

9. The illuminated sign according to claim 7, wherein said first passageway forms a message bearing indicia representative of DONT WALK; and wherein said said second passageway forms a message bearing indicia representative of WALK as used in pedestrian traffic signals.

10. The illuminated sign according to claim 7, wherein said first passageway forms a message bearing indicia representative of an X; and wherein said second passageway forms a message bearing indicia representative of a downwardly pointing arrow as used in a lane-use traffic control signal.

11. The illuminated sign according to claim 7, wherein said first passageway forms a message bearing indicia representative of a left arrow; and wherein said second passageway forms a message bearing indicia representative of a right arrow as used in a vehicle traffic control signal.

12. The illuminated sign according to claim 1, wherein said uniformly thick panel of solid transparent material includes a first transparent member made of a moldable material and having on each side thereof that is parallel to respective said frontwardly and rearwardly facing surfaces one of said first and said second passageways in the form of a trough mold formed therein, each of said first and second troughs opening outwardly in respective directions transverse of said frontwardly and rearwardly facing surfaces, wherein a second transparent member is sealingly attached to said first transparent member to sealingly cover all of said first trough, wherein a third transparent member is sealingly attached to said first transparent member to sealingly cover all of said second trough, wherein said electrodes in said first trough each include a wire segment extending through respective sealed openings therefor in said first and third transparent members, and wherein said electrodes in said second trough each include a wire segment extending through respective sealed openings therefor in said third transparent member.

13. The illuminated sign according to claim 1, wherein regions of said panel whereat electrodes for facilitating the electrical energization of said gas in respective said first and second passageways are located are covered by a mask member secured to said frontwardly facing surface.

14. The illuminated sign according to claim 1, wherein an electrical heater is provided on said rearwardly facing surface adjacent said second passageway for heating said gas in said second passageway.

15. The illuminated sign according to claim 14, wherein said electrical heater includes a heater wire connected in series with a thermostat for controlling the supply of electrical energy to said heater wire to periods of time where a temperature of said rearwardly facing surface is below a specified temperature setting on said thermostat.

16. The illuminated sign according to claim 1, wherein said uniformly thick panel of solid transparent material is mounted in a housing having an open front side and a closed back side, said uniformly thick panel of solid transparent material occupying a majority of an area of said open front side; wherein said uniformly thick panel of solid transparent material is oriented between separate and spaced therefrom plates so as to isolate said panel from cold climate conditions; and wherein said plate adjacent and spaced from said frontwardly facing surface is transparent.

17. The illuminated sign according to claim 1, wherein said uniformly thick panel of solid transparent material includes a first transparent member having on opposing sides thereof one of said first and second passageways which are each in a form of a trough having a bottom wall, upstanding side walls and an open top, said first transparent member having a first thickness dimension; and wherein said uniformly thick panel of solid transparent material further includes a second transparent member sealingly attached to said first transparent member to sealingly close said open top of said first passageway; and wherein said uniformly thick panel of solid transparent material further includes a third member sealingly attached to said first transparent member on a side thereof remote from said second transparent member to sealingly close said open top of said second passageway; and wherein said second and third transparent members each have a second thickness dimension less than said first thickness dimension.

18. An illuminated sign, comprising:

a uniformly thick panel of solid transparent material having large area frontwardly and rearwardly facing surfaces, said panel including a first transparent member having on at least one side a passageway which is in a form of a trough having a bottom wall, upstanding side walls and an open top, said panel further including a second transparent member sealingly attached to said first transparent member to sealingly close said open top of said passageway;

an electrically energizable gas sealed in said passageway; and spaced electrodes in said passageway so that electrical energy applied to said electrodes will effect an electrical energization of said gas therein.

19. The illuminated sign according to claim 18, wherein said first transparent member includes third and fourth transparent members, said third transparent member having at least one elongate and continuous said passageway formed therethrough, said fourth transparent member being sealingly attached to a rearwardly facing surface of said third transparent member to define said bottom wall of said passageway.

20. The illuminated sign according to claim 18, wherein an electrical heater is provided on said rearwardly facing surface of said first transparent member and adjacent said passageway for heating said gas in said passageway.

21. The illuminated sign according to claim 20, wherein said electrical heater includes an elongate electrical heater wire which extends coextensively with said passageway.

22. An illuminated sign, comprising:

a uniformly thick panel of solid transparent material having large area frontwardly and rearwardly facing surfaces;

at least one elongate and continuous passageway in said panel oriented between said frontwardly and rearwardly facing surfaces, said passageway being oriented uniformly adjacent one of said frontwardly facing surface and said rearwardly facing surface, said passageway being visible through at least one of said frontwardly facing surface and said rearwardly facing surface;

an electrically energizable gas sealed in said passageway;

spaced electrodes in said passageway so that electrical energy selectively applied to said electrodes in said passageway will effect an electrical energization of said gas therein; and an electrical heater on said rearwardly facing surface and adjacent a rear side of said passageway for heating said gas in said passageway.

23. The illuminated sign according to claim 22, wherein a second passageway is provided independent of said passageway and is oriented to one lateral side of said passageway so that side-by-side message indicia will be simultaneously or alternatingly displayed.

24. The illuminated sign according to claim 22, wherein said electrical heater includes an elongate electrical heater wire which extends coextensively with said passageway.

* * * * *